US006237751B1

(12) United States Patent
Ratz

(10) Patent No.: US 6,237,751 B1
(45) Date of Patent: May 29, 2001

(54) CLAMPING CLAW FOR AN ENDLESS CONVEYER

(75) Inventor: Holger Ratz, Frankenthal (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/269,761

(22) PCT Filed: Oct. 4, 1997

(86) PCT No.: PCT/DE97/02280

§ 371 Date: Apr. 8, 1999

§ 102(e) Date: Apr. 8, 1999

(87) PCT Pub. No.: WO98/16453

PCT Pub. Date: Apr. 23, 1998

(30) Foreign Application Priority Data

Oct. 12, 1996 (DE) ..... 196 42 117

(51) Int. Cl.[7] ..... B65G 47/86

(52) U.S. Cl. ..... 198/803.7; 271/204

(58) Field of Search ..... 198/470.1, 803.7; 271/204

(56) References Cited

U.S. PATENT DOCUMENTS

| | | | | |
|---|---|---|---|---|
| 3,055,480 | | 9/1962 | Hyman . | |
| 3,789,975 | * | 2/1974 | Ida et al. | 198/493 |
| 3,904,027 | | 9/1975 | Gilles et al. . | |
| 3,960,264 | | 6/1976 | Carbine et al. . | |
| 4,108,300 | * | 8/1978 | Hayase et al. . | |
| 4,167,996 | | 9/1979 | Cutter . | |
| 4,467,912 | * | 8/1984 | Rathert | 198/803.7 |
| 4,536,921 | * | 8/1985 | Brendel et al. | 24/132 WL |
| 4,550,905 | * | 11/1985 | Heiland | 271/202 |
| 4,598,492 | * | 7/1986 | Stanfield | 43/5 |
| 4,638,906 | * | 1/1987 | Winiasz . | |
| 4,681,213 | * | 7/1987 | Winiasz . | |
| 4,697,971 | * | 10/1987 | Muller | 412/33 |
| 4,721,296 | * | 1/1988 | Mowry | 270/52.2 |
| 4,746,007 | * | 5/1988 | Houseman | 198/470.1 |
| 4,846,064 | * | 7/1989 | Hoshi | 101/419 |
| 4,905,986 | * | 3/1990 | Muller | 271/277 |
| 4,915,283 | * | 4/1990 | Buchko et al. | 226/173 |
| 4,968,081 | * | 11/1990 | Beight et al. . | |
| 4,982,834 | * | 1/1991 | Jacobsen | 198/803.7 |
| 5,064,187 | | 11/1991 | Müller . | |
| 5,172,802 | * | 12/1992 | Wells | 198/470.1 |
| 5,178,262 | | 1/1993 | Merkli et al. . | |
| 5,248,135 | * | 9/1993 | Leu . | |
| 5,328,017 | * | 7/1994 | Carlen . | |
| 5,339,949 | * | 8/1994 | Jensen | 198/803.9 |
| 5,356,128 | * | 10/1994 | Eberle et al. . | |

(List continued on next page.)

FOREIGN PATENT DOCUMENTS

| | | |
|---|---|---|
| 2212523 | 9/1972 | (DE) . |
| 3516853A1 | 11/1985 | (DE) . |
| WO 91/07342 | 10/1990 | (DE) . |
| 4014877A1 | 11/1991 | (DE) . |
| 4042375A1 | 11/1991 | (DE) . |
| 4320085A1 | 5/1994 | (DE) . |
| 0386442A2 | 1/1990 | (EP) . |
| 589389 | 6/1947 | (GB) . |

*Primary Examiner*—Joseph E. Valenza
(74) *Attorney, Agent, or Firm*—Jones, Tullar & Cooper, P.C.

(57) ABSTRACT

A clamping claw assembly is secured to an endless transport device, such as a chain conveyor. A fixed clamping jaw is engaged by a movable clamping jaw to secure a product placed between the two. The movable clamping jaw is carried by a lever arm which is movable by an actuating lever. The actuating lever is biased by a tension spring between stable open and closed positions, through a dead center position. The movable clamping jaw is in a locked condition when it is in its closed position due to the force applied by the tension spring.

3 Claims, 3 Drawing Sheets

U.S. PATENT DOCUMENTS 5,360,101 * 11/1994 Carlen .
5,374,093 * 12/1994 Klopfenstein ..... 294/104
5,380,000 * 1/1995 Ohno ..... 271/277
5,395,151 * 3/1995 Eberle .
5,425,837 * 6/1995 Hansch ..... 156/536
5,575,379 11/1996 Schmetzer .
5,932,081 * 8/1999 Kopp et al. ..... 205/137

* cited by examiner

CLAMPING CLAW FOR AN ENDLESS CONVEYER

FIELD OF THE INVENTION

The present invention relates to a clamping claw for an endless conveyor such as a chain conveyor. A fixed clamping jaw and a movable clamping jaw are provided. The movable clamping jaw has closed and opened positions on either side of a dead center position. A lever arm is used to move the movable clamping jaw.

DESCRIPTION OF THE PRIOR ART

A prior art clamping claw for an endless conveyor is known from EP 0 386 442 A2, wherein a first, fixed clamping jaw is arranged in an open position, and in which a pivotably seated second clamping jaw can be moved against the first clamping jaw. The pivotable clamping jaw is arranged on a first lever arm of a three-armed lever. An actuating roller for actuating the clamping jaw in its open and closed position is seated on a second lever arm. A third lever arm is embodied as an element of a device for introducing the clamping force, wherein this device overcomes a dead center when the clamping jaw is actuated.

U.S. Pat. No. 3,055,480 describes an endless conveyor for paper products, wherein the paper products are held by means of automatic locking between two clamping jaw. For opening, one of the clamping jaw is directedly actuated by means of a lever.

SUMMARY OF THE INVENTION

The object of the present invention is based on providing a clamping claw for an endless conveyor.

In accordance with the present invention, this object is attained by providing a clamping claw for an endless conveyor, such as a chain conveyor. A first fixed clamping jaw and a second movable or adjustable clamping jaw are provided. A lever is used to bring the adjustable jaw into open and closed positions by overcoming a center position. A spring is used to hold the adjustable jaw in its open and closed positions.

The advantages which can be attained by means of the present invention reside, in particular, in that a clamping claw has been created with the use of a few components, whose movable clamping jaw is maintained, after passing dead center, in two defined end positions by means of a spring force.

It is of particular advantage that in the closed position the movable clamping jaw applies automatic locking to the clamped printed product. In the clamped position, it is impossible to pull out, and therefore to lose, the printed product to be conveyed. It is furthermore possible to do without large spring forces because of the presence of the self-securing clamping jaws. This results in increased service life of the components of the clamping claw.

The clamping claw is designed without a housing. Each clamping claw has a clamping claw bottom, which constitutes a stop for the products to be picked up. This stop assures a gentle pick-up as well as an error-free deposit of the product to be conveyed.

A simple construction which has a force gradient, and which is easy on the components, is achieved in that an actuation force and/or the clamping force is additionally introduced into a lever supporting the clamping jaw.

BRIEF DESCRIPTION OF THE DRAWINGS

A preferred embodiment of the present invention is represented in the drawings and will be described in greater detail in what follows.

Shown are in

DESCRIPTION OF THE PREFERRED EMBODIMENT

Figure 1:
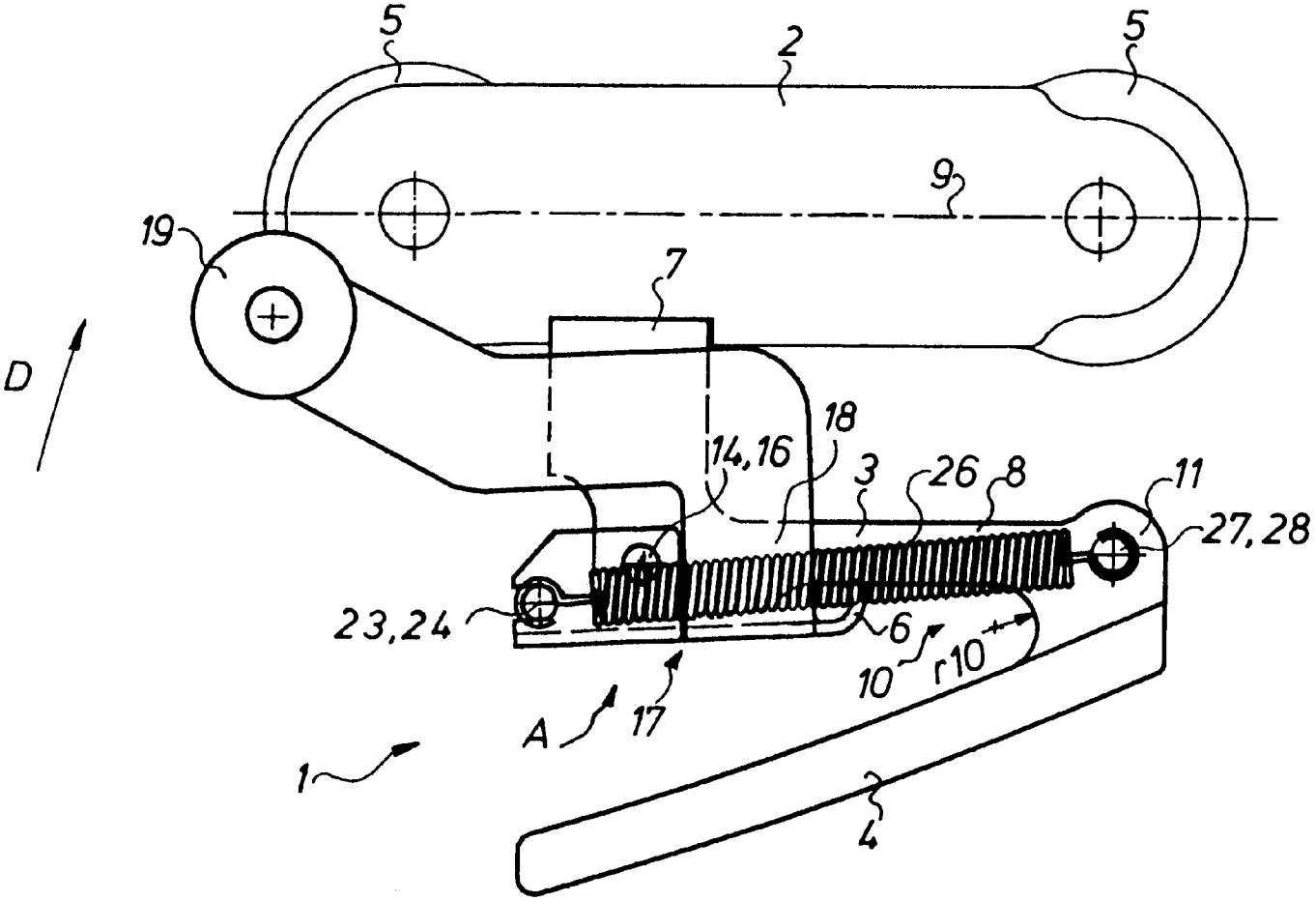
FIG. 1, a schematic representation of a lateral view of a clamping claw in the open position.

A clamping claw 1 for an endless conveyor which, for example, is connected downstream of a rotary printing press, and which may be a chain conveyor, essentially consists of a fixed first clamping jaw 4, fastened by means of a support 3 on a chain link 2 of a traction means of the chain conveyor, and of a movable second clamping jaw 6, which works together with the first fixed clamping jaw 4. The chain link 2 has at least on both ends a roller 5, which rollers run in a chain guide, not specifically represented.

It is also possible to use cables, belts or toothed belts, for example, instead of a chain, as traction means.

The support 3 for the first clamping jaw 4 is designed to be L-shaped, for example. A short leg 7 of the support 3 extends at right angles in respect to a longitudinal axis 9 of the chain link 2 and is connected with the chain link 2. A long leg 8 of the support 3 is arranged parallel with the longitudinal axis 9 of the chain link 2. An outer free end 11 of the long leg 8 is designed to be V-shaped and is connected with the first clamping jaw 4. A clamping jaw bottom 10 formed by the juncture of long leg 8 and clamping jaw 4 has a radius r10. The radius r10 is greater than a radius of a front edge 12 of an object, for example a printed product 13, conveyed by means of the clamping claw 1 as may be seen by referring to FIG. 2.

The support 3 has a bore 14 at the junction of support legs 7 and 8, which extends at right angles to the longitudinal axis 9 of the chain link 2. A pivot shaft 16 of a lever 17 is arranged in this bore 14. The lever 17 has a first lever arm 18, on which the adjustable, pivotable clamping jaw 6 is fastened, and into which the actuating forces are introduced. For this purpose, the first lever arm 18 is provided, on its extended free end with a roller 19 for actuating the lever 17. Lever 17 also has a second lever arm 22 which is seen more clearly in FIGS. 2 and 3. On its end, the second lever arm 22 has a bearing bolt 23, which is used as the point 24 of application of the force from an end attachment or first of a tension spring 26 that functions as an energy storage device. On its other or second end, the tension spring 26 has an abutment 27, which is in operative connection with a bearing bolt 28 located on the outer end 11 of the long leg 8 of the support 3.

The support 3, which is L-shaped in cross section, extends in the parallel direction in relation to the pivot shaft 16. The support 3 has at least the width of a chain link 2. The first clamping jaw 4 located on the support 3 is wider, for example twice as wide, as the support 3.

The lever 17 can be arranged as two lever members carried on the ends of the pivot shaft 16 respectively on both sides of the support 3 and connected by means of the second clamping jaw 6. Therefore two tension springs 26 have been employed, and each one of the two first lever arms 18 supports a roller 19. The second clamping jaw 6 can be provided with a radius on its end acting against the inside of the first clamping jaw 4. Undesirable impressions on the printed product 13 are prevented by means of this.

A distance a1 between the free end of the clamping jaw 6, i.e. the contact zone between the printed product 13 and the pivot shaft 16 of the clamping jaw 6, preferably is slightly larger than the shortest distance between the pivot shaft 16 and the inside surface of the clamping jaw 4. This distance a1 may be seen in FIG. 2.

The clamping jaw 6 is placed against the printed product 13 in such a way that the printed product 13 is clamped between the two clamping jaws 4, 6. In the closed position of the clamping jaw 6, automatic locking is applied to the printed product 13. For this purpose, a straight line 33 extending between the end of the clamping jaw 6; i.e. the point of the contact zone formed by the printed product 13 and the clamping jaw 6, and the pivot shaft 16 of the clamping jaw 6, and a tangent line placed against a contact zone between the printed product 13 and the clamping jaw 4, form an opening angle $\alpha$. In a simplifying way, this opening angle $\alpha$ will be identified as the opening angle which is enclosed by the two clamping jaws 4, 6. This opening angle $\alpha$, which is required for automatic locking in a direction away from the clamping jaw bottom 10, is a function of the coefficient of friction between the clamping jaws 4, 6 and the printed product 13 and is greater than 45°, preferably is greater than 60° and is less than 90°. Therefore a printed product 13, which is held fast between the end of the second clamping jaw 6 and the inside of the first clamping jaw 4 cannot be pulled out.

The operation of the clamping claw 1, in accordance with the present invention is described in what follows:

The clamping claw 1 arranged on a chain link 2 of the chain conveyor initially is in an open position A as shown in FIG. 1. At a loading station, for example at a paddle wheel of a folding apparatus, a printed product 13 is conducted between the clamping jaws 4, 6. As a result of the actuation of the first lever arm 18 in a clockwise direction of rotation D, the bearing bolt 23 with the point 24 of application of force from the spring 26 describes a circle around the pivot shaft 16. The radius of the circle corresponds to the length of the lever arm 22. In the process, the point 24 of application of force of the tension spring 26 passes, from a stable position A below a dead center position B, to a dead center position B. In the course of this, the tension spring is tensed. The dead center position B is represented by a straight line 29 connecting the point 24 of application of force of the tension spring 26, the pivot shaft 16 of the lever 17, and the abutment 27 of the tension spring 26. After passing through this dead center position B, the tension spring 26 contracts again. The free end of the second clamping jaw 6 comes to rest against the printed product 13 in the closed position C which is shown in FIGS. 2 and 3.

The stable positions, which are in the open and closed positions A, C of the second clamping jaw 6, are achieved since distance between the point 24 of the application of force and the abutment 27 of the tension spring 26 in the open and closed positions are less than the length of the spring 26 in the dead center distance, i.e. of this distance in the dead center position. The clamping jaw 6 is therefore held in the open and closed positions by the force storage device 26, i.e. without continued force applied by, for example, a cam control. The thickness of the printed product 13 can be between 0.1 mm and several millimeters.

Figure 2:
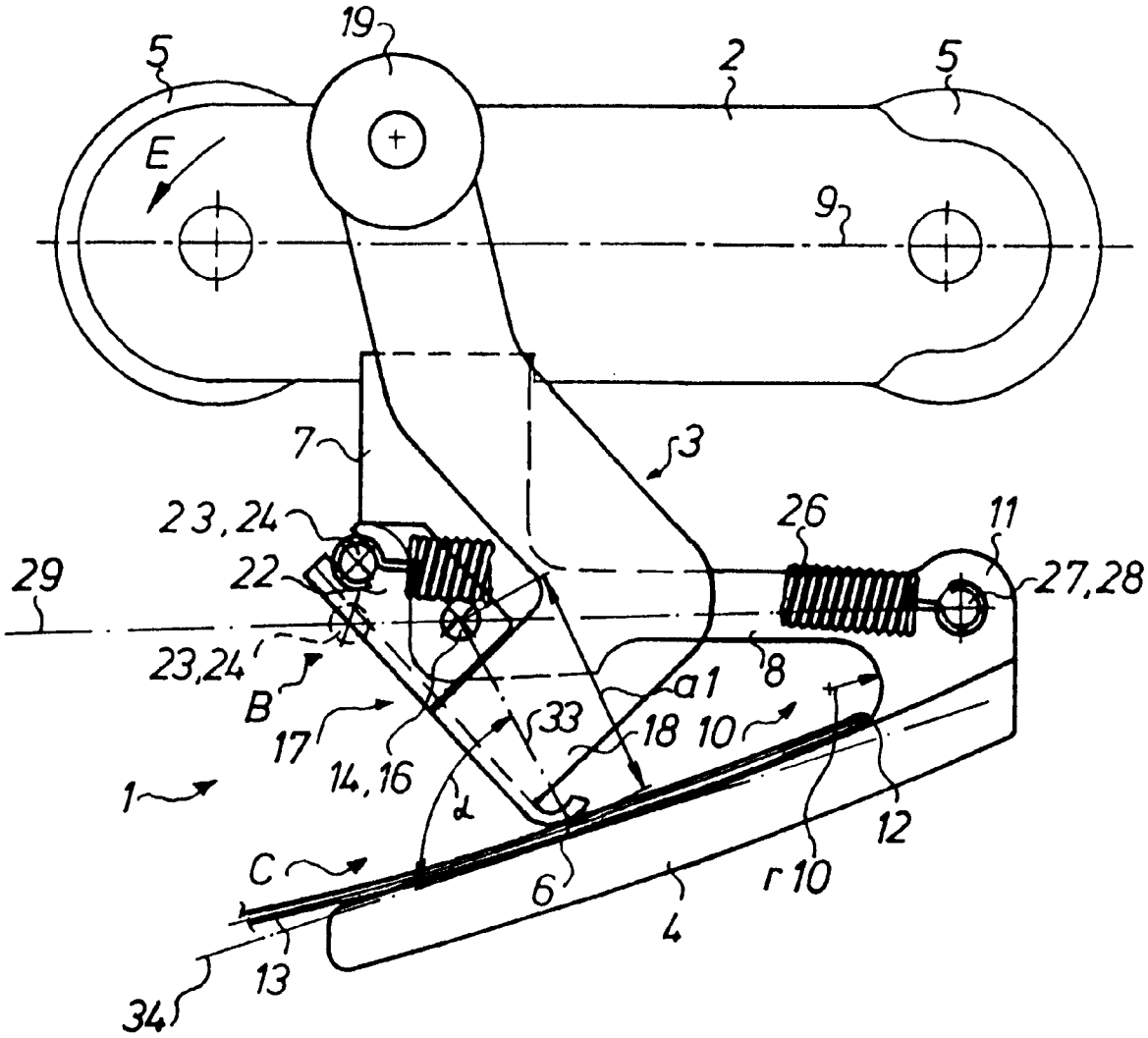
FIG. 2, a schematic representation of a lateral view of a clamping claw in the closed position; and in FIG. 3, a schematic representation analogous to FIG. 2, but with a second embodiment of the actuating lever.
Figure 3:
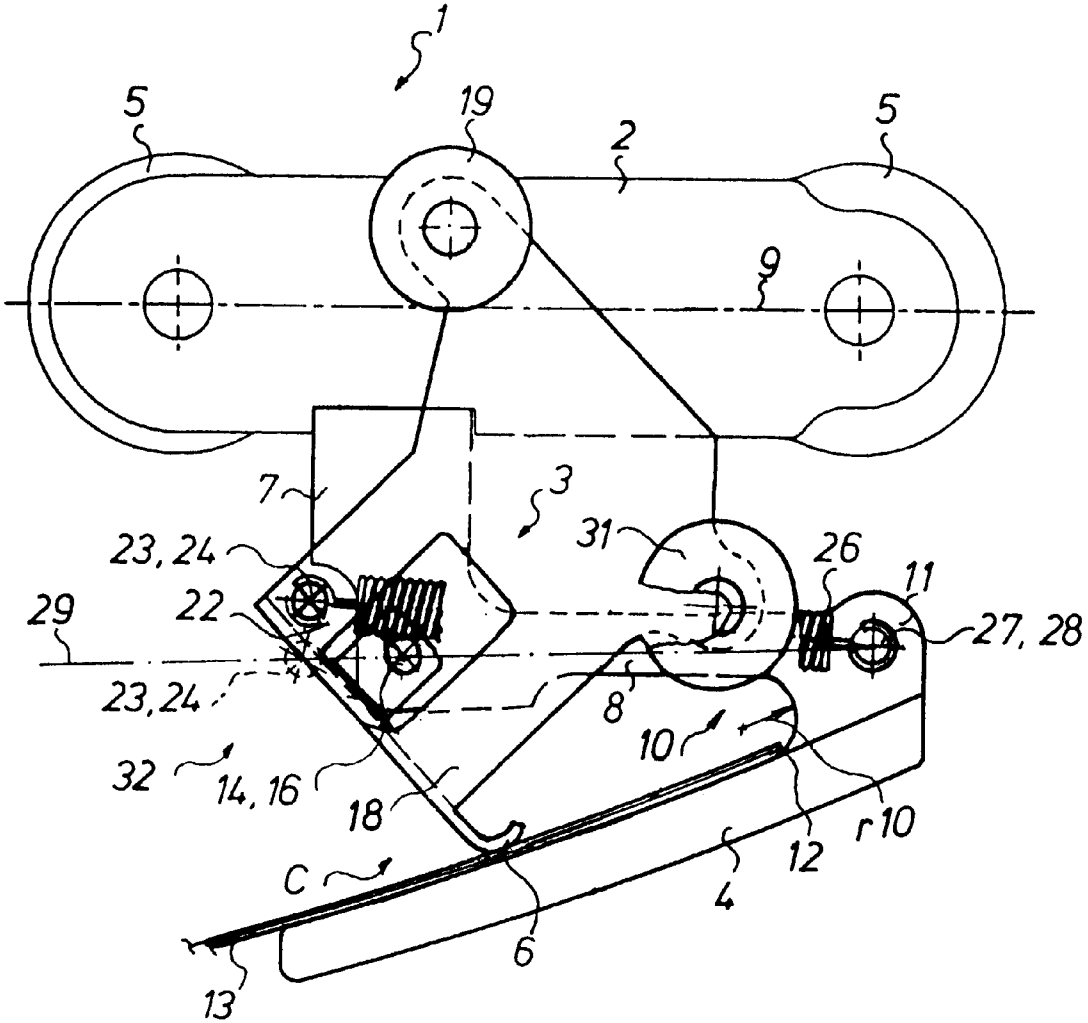

When the printed product 13 is to be released, the first lever arm 18 is actuated in a counterclockwise direction E as shown in FIG. 2. After passing through the dead center position B, the second clamping jaw 6 again takes up a stable position in the open position A.

In accordance with a second preferred embodiment, a further roller 31 is assigned to the first lever arm 18 of a lever 32, which lever 32 is analogous to lever 17. This second roller 31 is arranged between the first roller 19 and the clamping jaw 6.

The arrangement of a second roller 31 in addition to the roller 19 is advantageous due to the fact that switching of the second clamping jaw 6 into the end positions A, C can be performed by means of different rollers 19, 31.

In place of the lever 17, 32 having two lever arms, it is possible to provide only a single lever arm. The adjustable clamping jaw 6 is fastened on this single lever arm, and the fastening forces for moving the clamping jaw 6 into its open and closed position as well as the clamping forces are introduced there.

While preferred embodiments of a clamping claw for an endless conveyor in accordance with the present invention have been set forth fully and completely hereinabove, it will be apparent to one of skill in the art that a number of changes in, for example the type of printing press being used, the type of folder used, and the like may be made without departing from the true spirit and scope of the present invention which is accordingly to be limited only by the following claims.

What is claimed is:

1. A clamping claw for an endless conveyor comprising:

a support secured to the endless conveyor, said support including a first end secured to said endless conveyor, and a second end;

a first, fixed clamping jaw supported adjacent said second end of said support;

a second, movable clamping jaw cooperating with said first, fixed clamping jaw;

a pivotable lever carried by said support adjacent said first end of said support, said pivotable lever having a first lever arm and a second lever arm said second lever arm being pivotable about a pivot shaft passing through said support, said first lever arm being attached to said second, movable clamping jaw, said second lever arm being pivotable on said pivot shaft to move said second movable clamping jaw between an open position, an intermediate center position, and a closed position with respect to said first fixed clamping jaw; and A force storage device having a first end secured to said second lever arm and having a second end secured to said second end of said support said first and second ends of said force storage device being located at first and second opposite sides of said pivot shaft, said force storage device generating an actuating force for moving said second, movable clamping jaw between said open and closed positions and for generating a clamping force on said second, movable clamping jaw in said closed position of said second movable clamping jaw, said second, movable clamping jaw being locked in said closed position by said force storage device moving past said center position.

2. The clamping claw of claim 1 wherein said fixed clamping jaw and said movable clamping jaw enclose an opening angle of greater than 45° in said closed position.

3. The clamping claw of claim 1 wherein said first, fixed clamping jaw and said support define a generally v-shaped clamping jaw bottom extending transverse to a longitudinal direction of the endless conveyor, said v-shaped clamping jaw bottom forming a stop for products received by said clamping claw.

* * * * *